US005507165A

United States Patent [19]

Hartley

[11] Patent Number: 5,507,165

[45] Date of Patent: Apr. 16, 1996

[54] HEMMING FIXTURE

[75] Inventor: William R. Hartley, Macomb, Mich.

[73] Assignee: Western Atlas, Inc., Hebron, Ky.

[21] Appl. No.: 287,958

[22] Filed: Aug. 9, 1994

[51] Int. Cl.[6] ..... B21D 5/16; B21D 39/02

[52] U.S. Cl. ..... 72/311; 72/210; 29/243.58

[58] Field of Search ..... 72/214, 220, 245, 72/210, 211, 311; 29/243.57, 243.58

[56] References Cited

U.S. PATENT DOCUMENTS

| | | | |
|---|---|---|---|
| 717,224 | 12/1902 | Le Maitre | 72/210 |
| 2,091,474 | 8/1937 | Elliott | 72/214 |
| 3,797,430 | 3/1974 | Boudreau | 29/243.57 |
| 4,989,308 | 2/1991 | Sanders | 72/210 |
| 5,228,190 | 7/1993 | Sawa | 29/243.57 |

*Primary Examiner*—Daniel C. Crane

*Attorney, Agent, or Firm*—Barnes, Kisselle, Raisch, Choate, Whittemore & Hulbert

[57] ABSTRACT

A device for prehemming at least a portion of an upstanding flange of a sheet metal panel which has a tapered roller which is moved into engagement with the flange while moving the roller along the flange with its axis of rotation disposed in a path which is substantially parallel to the fold line of the flange along the periphery of the panel. The roller is journalled for rotation on an arm pivotally carried by a slide which is moved by a drive cylinder along a lineal path generally parallel to the fold line of the portion of the flange to be prehemmed. As the slide moves linearly the arm is pivoted to move the roller transversely by a follower carried by the arm and received in an elongate cam track having a portion contoured to impart pivotal movement of the arm to cause the roller to follow the desired path of travel substantially parallel to the fold line of the flange for prehemming the flange by bending it to an acute included angle relative to an adjoining portion of the panel.

9 Claims, 3 Drawing Sheets

HEMMING FIXTURE

FIELD OF THE INVENTION

This invention relates to hemming sheet metal and more particularly to an apparatus for prehemming a flange of a sheet metal panel.

BACKGROUND

Doors, hoods, fenders, tail gates, trunk and deck lids of motor vehicles are usually formed by an outer sheet metal panel which is joined to an inner reinforcing panel around its periphery by hemming a flange around the periphery of the outer panel over an adjacent edge of the inner panel to secure the panels together.

Typically, this hemming is accomplished in two stages. In the first stage, with the reinforcing panel nested in the outer panel and received in a suitable fixture, a prehemming steel or tool engages and bends an upturned peripheral flange of the outer panel to an acute included angle with respect to an adjacent portion of the outer panel. Thereafter, a second hemming steel engages and completely bends the prehemmed flange of the outer panel over the peripheral edge and into engagement with the reinforcing panel to securely attach the panels together in a unitary structure. Typically, a plurality of both prehemming and final hemming steels or tools actuated by presses are grouped around the periphery of the outer panel to perform all prehemming and hemming operations for one assembly of an outer and a reinforcing panel.

For a typical assembly, the flange around the outer panel can be formed at substantially a right angle to the adjacent portion of the outer panel which is necessary for a satisfactory prehemming operation. However, if the outer panel has a cambered or inclined portion adjacent to its periphery, when the flange is formed, such as by sheet metal stamping, it may be at an obtuse included angle to the immediately adjacent cambered portion of the panel. This situation frequently occurs in the portion of the deck lid adjacent the rear window and quarter panel area of a vehicle and in the area of the hood adjacent the front window and fender portion of the vehicle. Previously, any portion of a flange at an obtuse included angle had to be bent to an acute included angle by striking it either manually with a hammer or with an automated wiper tool actuated by a cylinder both of which produce inconsistent results and result in a completed hem of poor quality appearance of the bend and an unacceptable fold line around the periphery of the outer panel. Typically, this fold line is so wavey and of such poor quality that surface filling and fairing operations are required to provide a suitable exterior surface for painting or other finishing of the panel. This is costly, inefficient and ineffective.

SUMMARY OF THE INVENTION

For prehemming the flange area of a panel inclined at an obtuse included angle, an apparatus having a conical or tapered roller engagable with the flange with its axis of rotation movable along a path generally parallel to the fold line of the flange to bend the flange to an acute included angle relative to the panel portion adjacent the flange. Preferably, the roller is journalled adjacent one end on an arm pivotally carried by a slide and having a cam follower adjacent the other end of the arm. To bend the flange as the slide is moved in a straight line motion, preferably by a cylinder, the follower engages a cam surface to pivot the arm so that the roller moves along a path substantially parallel to the fold line.

Objects, features and advantages of this invention are to provide a prehemming apparatus which produces a consistent prehem and fold line of a flange of an outer panel, eliminates highlights and distortion of the outer panel, prehems flanges which are at an obtuse included angle to the adjacent portion of the outer panel, produces a finished hem with improved quality of appearance and tolerances, readily follows the contour of curved bend lines, is of relatively simple design, compact construction and arrangement, and is rugged, reliable, durable, stable in operation, of economical manufacture and assembly, has a long useful life in service and requires relatively little maintenance and repair in use.

BRIEF DESCRIPTION OF THE DRAWINGS

These and other objects, features and advantages of this invention will be apparent from the following detailed description of the best mode, appended claims and accompanying drawings in which:

DETAILED DESCRIPTION OF THE INVENTION

Figure 1:
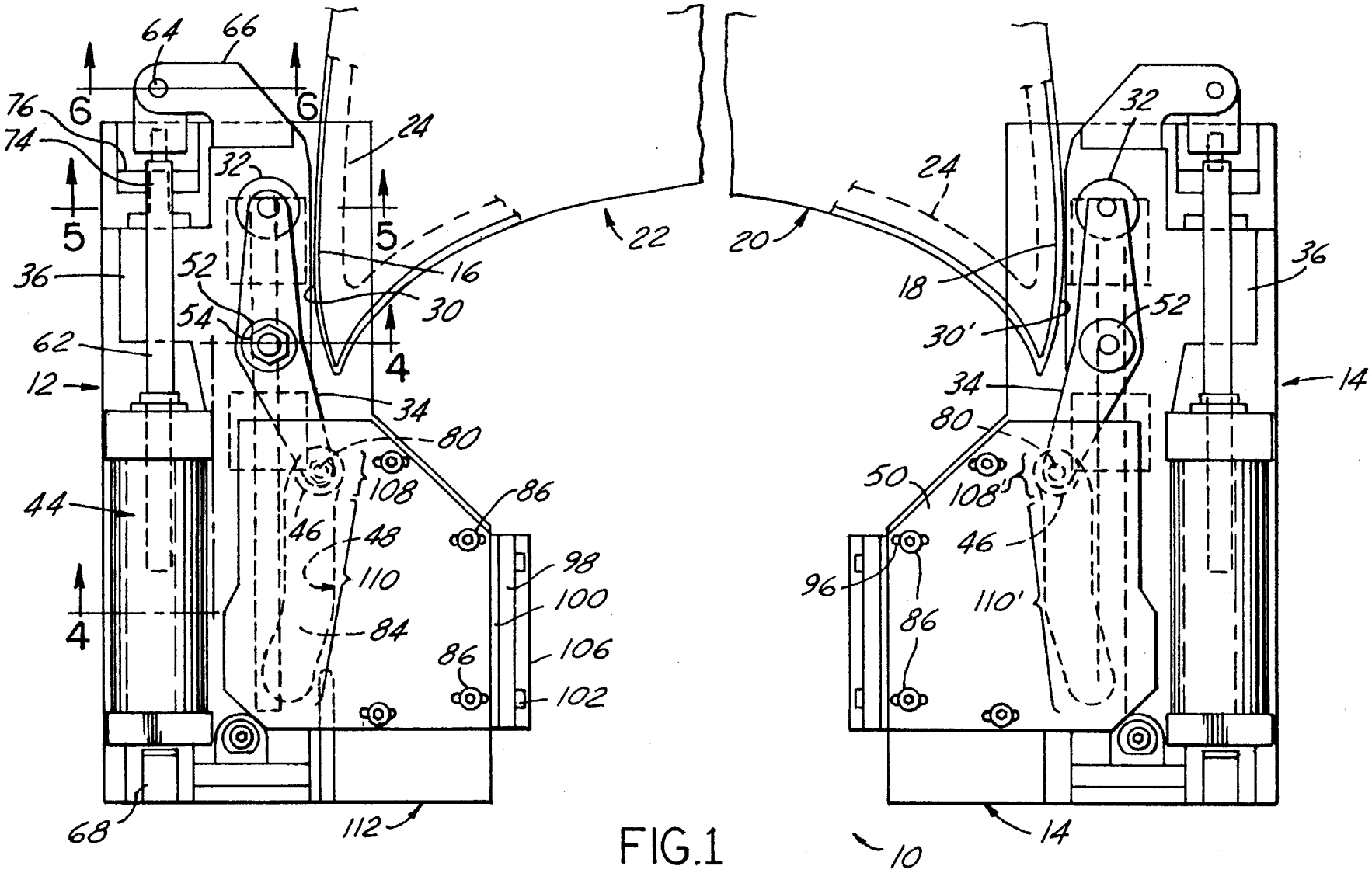
FIG. 1 is a fragmentary top view of a fixture with a prehemming apparatus embodying this invention.
Figure 2:
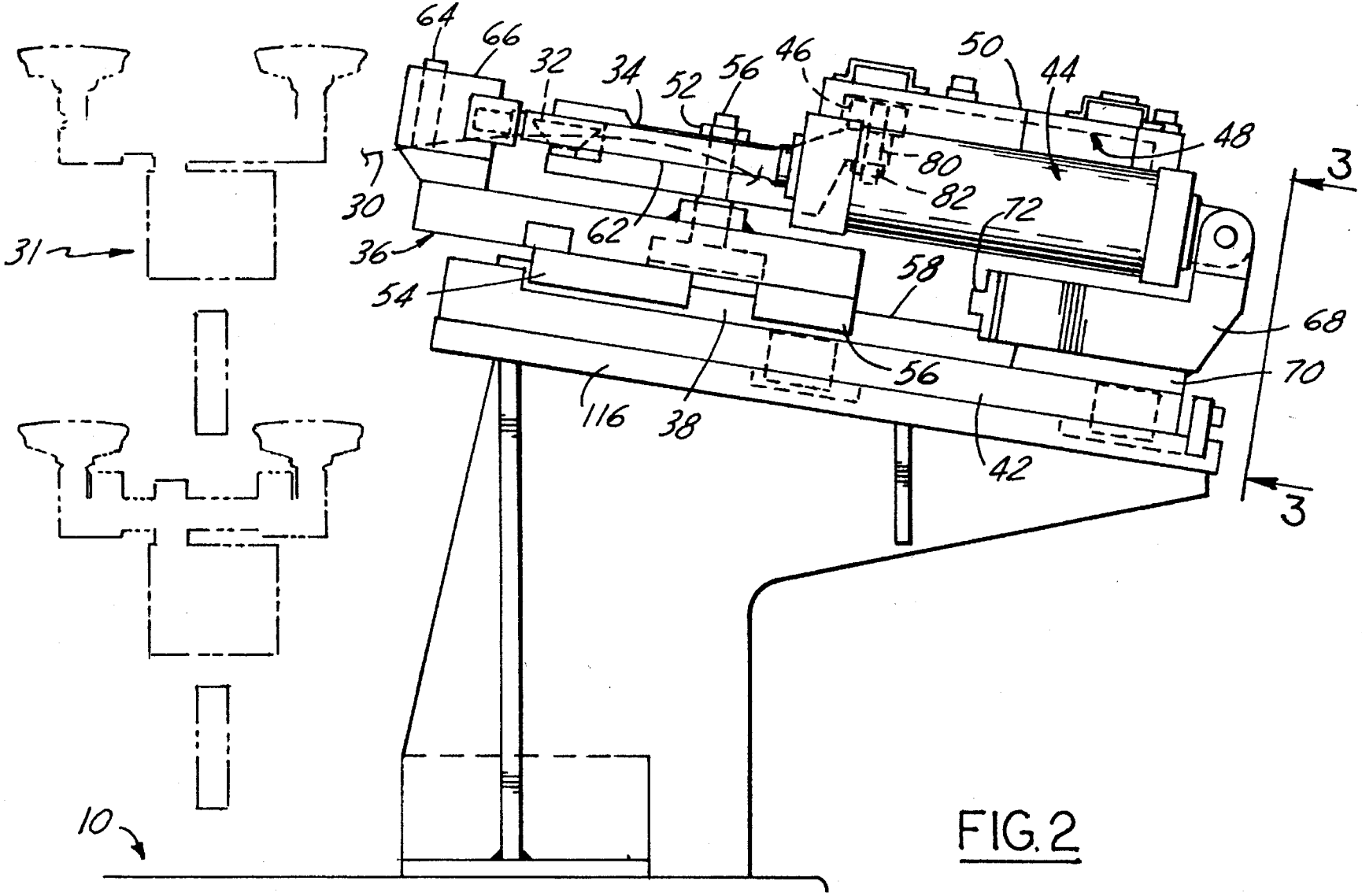
FIG. 2 is a fragmentary side view of the apparatus of FIG. 1.
Figure 7:
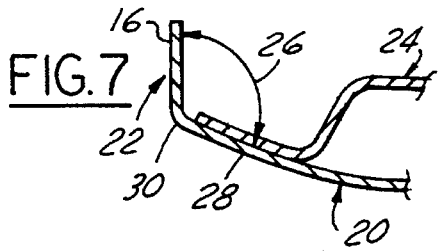
FIG. 7 is a fragmentary sectional view of a portion of a reenforcing panel nested in an outer panel of a trunk for an automobile before prehemming of the flange of the outer panel by the apparatus of FIG. 1.

Referring in more detail to the drawings, FIG. 1 illustrates a fixture 10 with a pair of prehemming devices 12 and 14 for prehemming flange portions 16 and 18 of an outer sheet metal panel 20 of a rear deck lid or trunk 22 for an automobile. A reinforcing panel 24 is nested within the outer panel and they are turned upside and down and disposed in the fixture so that the flanges to be prehemmed project upwardly. As shown in FIGS. 1 and 7, before prehemming, the flange portions 16 & 18 are at an obtuse included angle 26 to the adjacent cambered or curved portions 28 of the outer panel and, as shown in FIGS. 1 & 2, they have a fold or bend line 30 along the periphery of the outer panel which is a compound curve. Because of this obtuse included angle, a conventional prehemming steel actuated by a prehemming apparatus or press cannot bend the flange portion to an acute included angle while maintaining a smooth and fair fold line. Indeed, frequently conventional prehemming tools and presses cannot bend the flange to an acute included angle at all and badly mangle and distort the flange as well as the fold line.

Preferably, the prehemming devices 12 & 14 are mounted in generally opposed relation in the fixture 10 and actuated to simultaneously prehem both the opposed flanges 16 & 18 so that opposing forces are simultaneously applied to the outer panel 20 to facilitate retaining it in a precise location in the fixture during the prehemming operations. Typically, the panel assemblies are automatically moved into and out of the fixture by a transfer mechanism 31.

Each device has a roller 32 journalled on a actuator arm 34 pivotally carried by a slide 36 received on guide rails 38,40 carried by a base plate 42 and reciprocated by a drive cylinder 44. As the slide is retracted, the arm is moved to force the roller into engagement with the flange to bend it into a prehem position by a follower 46 on the other end of the arm and received in a cam track 48 in a plate 50 carried by the base.

Since the prehem devices 16 & 18 are mirror images of one another, only the device 12 will be described in further detail. As shown in FIGS. 1 and 2, the arm 34 is journalled by a bearing 52 and retained by a lock nut 54 on a pivot shaft 56 fixed to the slide 36. The slide is attached to pairs of spaced apart carriages 54 & 56 mounted, preferably with roller bearing races, for lineal reciprocation on a pair of parallel rails 38 & 40 secured to the base plate. For reciprocating the slide, the cylinder 44 has a piston rod 62 connected to the slide by a pivot pin 64 and a clevice bracket 66 secured to the slide. The cylinder is pivotally connected to an upstanding bracket 68 fixed to a mounting plate 70 secured to the base plate. The extent to which the slide can be retracted is limited by a positive stop 72 mounted on the end of the bracket 68 and the extent to which it can be extended is limited by a bumper 74 fixed to the slide when it bears on a positive stop 76 secured to the base plate.

Figure 3:
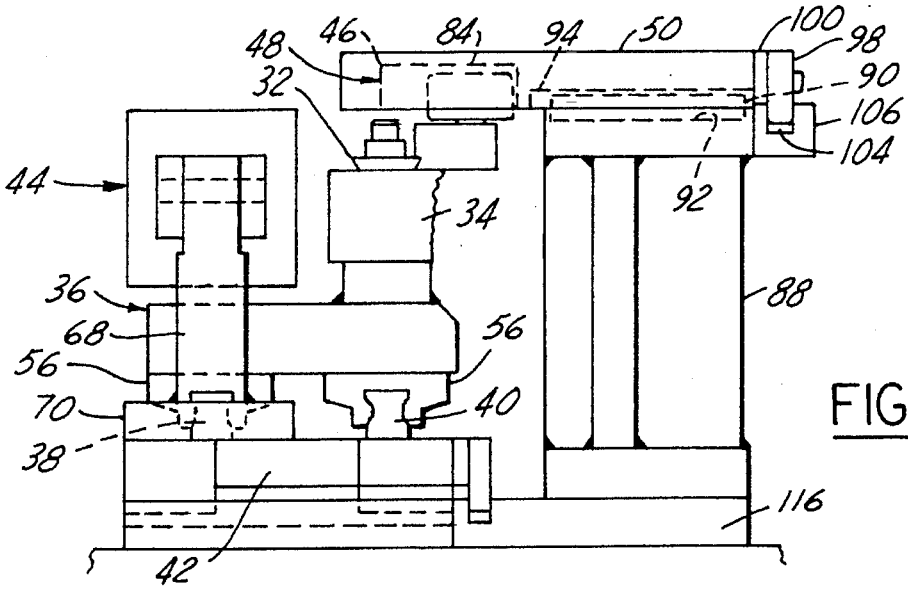
FIG. 3 is a fragmentary end view of the apparatus of FIG. 1.
Figure 4:
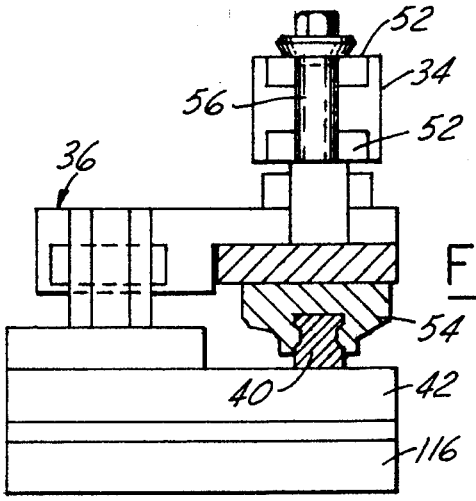
FIG. 4 is a sectional view taken generally on line 4—4 of FIG. 1.
Figure 5:
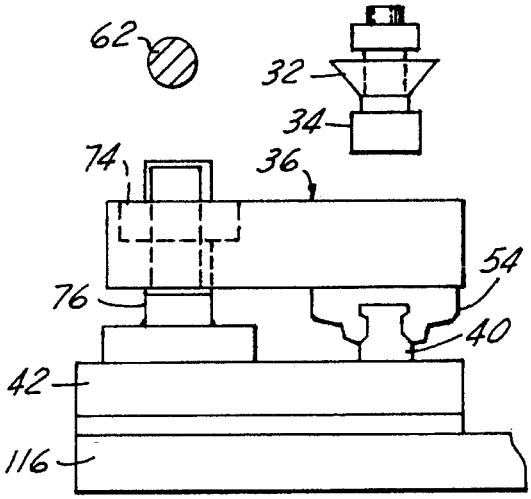
FIG. 5 is a sectional view taken generally on line 5—5 of FIG. 1.
Figure 6:
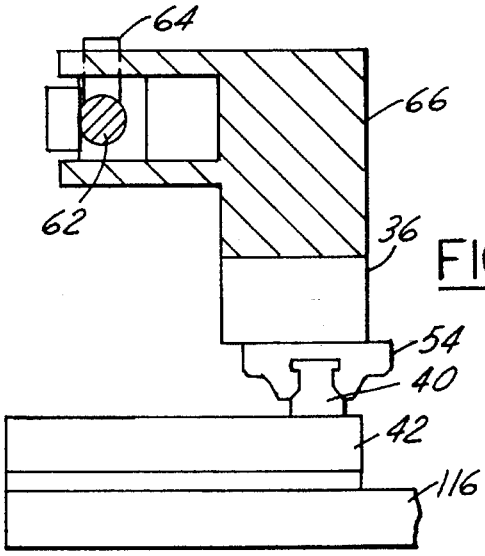
FIG. 6 is a sectional view taken generally on line 6—6 of FIG. 1.

In accordance with this invention, as the slide 36 is retracted, the flange 16 is prehemmed by moving the roller 32 into engagement with it and along a path substantially parallel to the flange fold line 30 or 30' by the cooperation of the follower roller 46 and the cam track 48. The follower roller 46 is journalled for rotation on a stub shaft 80 secured to the arm by a lock nut 82. The roller is received in the cam track 48 which is in the form of a groove or recess 84 in the underside of the plate 50 which is secured by cap screws 86 to a supporting pedestal 88 mounted on the base plate. To permit adjustment and fine tuning of the pivotal movement of the arm a key 90 (FIG. 3) in a recess 92 in the pedestal is slidably received in a groove 94 in the cam plate 50 and the cap screws 86 are received in elongate holes 96 through the plate. Once adjusted, the cam plate 50 is retained in position by the cooperation of a key bar 98 and spacers 100 secured to an edge of the cam plate by cap screws 102 and projecting into a complementary slot 104 in a bar 106 fixed to the pedestal.

Figure 8:
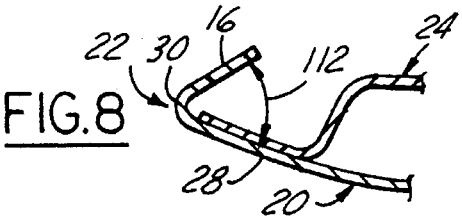
FIG. 8 is a fragmentary sectional view similar to FIG. 7 and showing the flange after prehemming by the apparatus of FIG. 1.

To impart the desired motion to the prehem roller 32, the cam track 48 has a first portion 108 which as the slide 36 is retracted, pivots the arm 34 to move the roller 32 into engagement with the flange and bend the portion bearing on it to an acute included angle and a second portion 110 which as the slide is further retracted causes the roller to follow a path substantially parallel to the fold line 30 or 30' of the flange as the roller bends succeeding portions of the flange on which it bears to an acute included angle such as the angle 112 shown in FIG. 8. Similarly, in the device 14 the cam track 48' has a first portion 108' and a second portion 110'. Preferably, to avoid any interference, the ends of the cam tracks 48 and 48' extend beyond the extent of travel of the follower roller 46 in the fully extended and fully retracted positions of the slide 36.

Preferably, but not necessarily, the radial distance between the pivot axis of the arm 34 and the axis of rotation of the hem roller 32 is equal to the radial distance between the pivot axis of the arm and the axis of rotation of the cam follower roller 46. If these radi are equal then the contour of the second portion 110 of the cam tracks 48 and 48' will be substantially the mirror image of the projected contour in the plane in which the arm moves of the fold line 30 or 30' of the flange 16 or 18 to be prehemmed.

As shown in FIGS. 1 & 2, each prehemming device 12 & 14 is mounted in the fixture 10 by a pedestal 112 and 114 so that the roller overlaps and lies adjacent to the flange and the lineal path of motion of the slide 36 and pivot of the arm is generally parallel to the bend or fold line 30 or 30' of the flange. This requires mounting the base of the device on a plate 116 (FIG. 2) of the pedestal which is inclined to a horizontal plane relative to two transverse axes in the plane.

In using the fixture, as shown in FIG. 1, the slides 36 of the prehemming devices 12 & 14 are disposed in the fully advanced position to retract the prehemming rollers 32 and the trunk lid assembly 22 of the outer panel 20 and the inner reinforcing panel 24 are turned upside down and placed, located and clamped in the fixture with the peripheral flanges 16 & 18 projecting upwardly. Preferably, both of the devices 12 & 14 are operated at the same time to simultaneously prehem both of the flanges 16 & 18 thereby applying opposing forces to the outer panel which facilitates maintaining the proper location of the outer panel in the fixture during the prehemming operation. To prehem each flange, the cylinder 44 is energized to retract the slide 36 which in cooperation with the cam track 48 and follower 46 pivots the arm 34 to move the roller into engagement with the flange to bend it to the prehemmed position (FIG. 8), as the roller is advanced along the flange in rolling contact therewith by the retraction of the slide by the cylinder. During initial retraction, the roller 32 is moved into engagement with the flange by pivotal movement of the arm by the follower 46 moving along the first portion 108 of the cam track 48 and on further retraction, the roller 32 is moved along the flange in a path generally parallel to the flange fold line 78 by the follower 46 traversing the second portion 110 of the cam track.

After the slide 36 has been fully retracted, the cylinder 44 is energized to advance the slide 36 which in cooperation with the follower and cam track causes the roller 32 to retrace its path so that the roller again passes along the flange and then retracts the roller from the flange which provides clearance for removal of the prehemmed panel assembly from the fixture. This second or rerolling of the flange is believed to also improve the accuracy and quality of the prehemming of the flange.

What is claimed is:

1. A device for hemming at least a portion of a flange having a fold line adjacent the periphery of a panel, comprising, a base, a slide carried by said base for reciprocation generally longitudinally of the fold line of a portion of the flange to be prehemmed of the panel, a drive operably connected with said slide for moving said slide generally longitudinally relative to the flange portion to be prehemmed, an arm carried by the slide, a prehem roller carried by the arm, the slide being constructed and arranged for moving the prehem roller carried by the arm generally transversely to the longitudinal path of travel of the slide, the prehem roller having an axis of rotation and a peripheral surface tapered relative to its axis of rotation, said roller being carried by said arm with its axis of rotation extending generally transversely to both the path of longitudinal movement of the slide and the path of generally transverse movement of the roller by the carrier arm, and a cam and an associated follower one of which is operably connected with said carrier arm, said cam having a profile and being constructed and arranged so that by lineal movement of the slide the roller is moved into engagement with the flange of the panel and the axis of rotation of the roller is moved along a path substantially parallel to the fold line of the flange portion as the roller is advanced along the flange portion by lineal movement of the slide to prehem the portion of the flange engaged by the roller to an acute included angle relative to the portion of the panel immediately adjacent the flange portion being prehemmed by the roller.

2. The prehemming device of claim 1 which also comprises a plate fixed relative to said base and wherein said cam comprises an elongate recess in said plate and said follower comprises a follower roller received in said recess and connected to said arm.

3. The apparatus for claim 2 wherein said arm is pivotally mounted on said slide at a point between said follower and said prehem roller.

4. The apparatus of claim 1 wherein said arm is pivotally mounted on said slide for moving said prehem roller generally transversely to the longitudinal path of travel of said slide.

5. The apparatus of claim 1 wherein said drive comprises a fluid actuated cylinder.

6. The apparatus of claim 1 wherein said prehem roller is journalled for rotation adjacent one end of said arm, said follower is a follower roller journalled for rotation adjacent the other end of said arm and said arm is pivotally mounted on said slide for pivotal movement about an axis which is located between the ends of said arm so that the radial distance between the pivot axis of said arm and the axis of said prehem roller is substantially equal to the radial distance between said pivot axis of said arm and the axis of rotation of said follower roller.

7. The apparatus of claim 2 wherein said prehem roller is journalled for rotation adjacent one end of said arm, said follower roller is journalled for rotation adjacent the other end of said arm, and said arm is pivotally mounted on said slide for pivotal movement about an axis which is located between the ends of said arm so that the radial distance between the pivot axis of said arm and the axis of said prehem roller is substantially equal to the radial distance between said pivot axis of said arm and the axis of rotation of said follower roller.

8. The apparatus for claim 7 wherein said drive comprises a fluid actuated cylinder.

9. A device for hemming at least a portion of a flange having a fold line with a curved portion adjacent the periphery of a cambered portion of a panel, comprising a base, a prehem roller carrier arm carried by said base, a prehem roller having an axis of rotation and a peripheral surface tapered relative to its axis of rotation, said prehem roller being journalled for rotation on said arm with its axis of rotation extending generally parallel to the portion of the flange to be prehemmed and generally transverse to an adjoining portion of the panel, and a drive mechanism connected to said arm and constructed and arranged to move said prehem roller into engagement with the flange and advance it, relative to the base, along the flange generally longitudinally relative to the portion of the flange to be prehemmed and with its axis of rotation moving along a path substantially parallel to the fold line including a curved portion of the fold line of the flange adjacent a cambered portion of the panel by moving the prehem roller generally transversely of the path of its longitudinal movement to prehem a portion of the flange engaged by the prehem roller from an obtuse included angle to an acute included angle relative to the cambered and curved portion of the panel immediately adjacent the flange portion being prehemmed by the prehem roller.

* * * * *